US009877534B2

(12) United States Patent
Steere

(10) Patent No.: US 9,877,534 B2
(45) Date of Patent: Jan. 30, 2018

(54) TOOL-FREE ACCESSORY RETAINING DEVICE FOR A HELMET

(71) Applicant: K-2 Corporation, Seattle, WA (US)

(72) Inventor: Nigel Bruce Edward Steere, Seattle, WA (US)

(73) Assignee: K2 Sports, LLC, Seattle, WA (US)

( * ) Notice: Subject to any disclaimer, the term of this patent is extended or adjusted under 35 U.S.C. 154(b) by 387 days.

(21) Appl. No.: 14/550,268

(22) Filed: Nov. 21, 2014

(65) Prior Publication Data

US 2015/0143616 A1 May 28, 2015

Related U.S. Application Data

(60) Provisional application No. 61/907,832, filed on Nov. 22, 2013.

(51) Int. Cl.

| | |
|---|---|
| ***A42B 1/24*** | (2006.01) |
| ***A42B 3/04*** | (2006.01) |
| ***A42B 3/12*** | (2006.01) |

(52) U.S. Cl.

CPC ..... *A42B 3/04* (2013.01); *A42B 3/127* (2013.01)

(58) Field of Classification Search

CPC ..... A42B 3/127; A42B 3/324; A42B 3/04; A63B 71/10; A61F 9/027

USPC ..... 2/414, 420, 422, 425, 452, 429

See application file for complete search history.

(56) References Cited

U.S. PATENT DOCUMENTS

| | | | | |
|---|---|---|---|---|
| 2,863,151 | A * | 12/1958 | Morgan, Jr. | A42B 3/127 2/414 |
| 4,282,610 | A * | 8/1981 | Steigerwald | A42B 3/127 2/414 |
| 5,277,174 | A * | 1/1994 | Schmidhauser | A61H 7/006 601/70 |
| 6,711,751 | B1 | 3/2004 | Muskovitz | |
| 6,851,129 | B2 * | 2/2005 | Gafforio | A42B 3/222 2/424 |
| 7,260,850 | B2 | 8/2007 | Ambuske | |
| 2016/0212869 | A1 * | 7/2016 | Gutschenritter | H05K 5/0221 |

* cited by examiner

*Primary Examiner* — Tejash Patel
(74) *Attorney, Agent, or Firm* — Christensen O'Connor Johnson Kindness PLLC

(57) ABSTRACT

A retaining system includes a receiver comprising: a holder with a first side and an opposite second side and an eccentric aperture extends from the first side to the second side of the holder; a column comprising a central axis, a first axial side, and a second opposite axial side; and a flange attached normal to the column at the second side, wherein the column and flange are engaged with the holder, wherein the flange has an outer shape that fits within the eccentric aperture, and the column passes within the eccentric aperture from the first side to the second side of the holder, wherein the flange and column are rotatable around the central axis, and the column resists rotating without some resilient deformation of either the column, the flange, or the holder. The retaining system may be used to hold straps, such as from goggles, next to the side of a helmet.

23 Claims, 4 Drawing Sheets

TOOL-FREE ACCESSORY RETAINING DEVICE FOR A HELMET

CROSS-REFERENCE TO RELATED APPLICATION

This application claims the benefit of Provisional Application No. 61/907,832, filed Nov. 22, 2013, the entire disclosure of which is expressly incorporated herein by reference.

BACKGROUND

Most helmets have a method for retaining goggles and headlamps by holding the straps that are used with such accessories. Some sort of clip or hook is placed on the helmet to secure the straps. Goggles, headlamps, or other accessories are not always used, however, and it is desirable to be able to remove the clips from the helmet or to reconfigure them to be usable at different locations on the helmet for different accessories.

Accordingly, a means to easily remove and reattach clips from the helmet is desirable.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Embodiments relate to a retaining system. The retaining system can be used on headgear, helmets, and the like. The retaining system is used to secure accessories, such as goggles, to the headgear. The retaining system includes a receiver comprising a holder with a first side and an opposite second side and an eccentric aperture extends from the first side to the second side of the holder; a column comprising a central axis, a first axial side, and a second opposite axial side; and a flange attached normal to the column at the second side, wherein the column and flange are engaged with the holder, wherein the flange has an outer shape that fits within the eccentric aperture, and the column passes within the eccentric aperture from the first side to the second side of the holder, wherein the flange and column are rotatable around the central axis, and the column resists rotating without some resilient deformation of either the column, the flange, or the holder.

In some embodiments of the retaining system, the eccentric aperture has an elliptical shape having a major axis and a minor axis, and the flange has a major axis and a minor axis slightly smaller than the major axis and minor axis of the eccentric aperture.

In some embodiments of the retaining system, the major axis of the flange is aligned with the major axis of the eccentric aperture, and the flange is free to move in a direction parallel to the central axis within the eccentric aperture.

In some embodiments of the retaining system, the major axis of the flange is not aligned with the major axis of the eccentric aperture, and the flange rests against the second side of the holder and is prevented from movement in a direction parallel to the central axis.

In some embodiments of the retaining system, a cross-sectional shape of the column has an axis that is greater than the minor axis of the elliptical eccentric aperture and smaller than the major axis of the elliptical eccentric aperture.

In some embodiments of the retaining system, the holder has a wall forming the eccentric aperture, wherein a height of the wall is greater than a thickness of the wall.

In some embodiments of the retaining system, a cross-sectional shape of the column engaged with the eccentric aperture is described by the intersection of two equal orthogonal axes, each one being greater than the minor axis of the elliptical shape and smaller than the major axis of the elliptical shape.

In some embodiments of the retaining system, the cross-sectional shape of the column includes four curved elliptical segments, wherein two opposite segments are in contact with the eccentric aperture at the minor axis.

In some embodiments of the retaining system, the receiver further comprises an anchor structure attached to the holder.

In some embodiments of the retaining system, a clamp arm is connected to the first side of the column, wherein the clamp arm extends radially from the column.

In some embodiments of the retaining system, the eccentric aperture has a shape other than circular.

Some embodiments relate to a helmet having any of the embodiments of the retaining system.

Some embodiments relate to a helmet including an interior foam layer; an exterior hard shell attached to the interior foam layer, wherein a recess is provided in the exterior hard shell and interior foam layer; and a receiver placed in the recess, wherein the receiver comprises an anchor immovably attached to the recess and a holder connected to the anchor, wherein the holder includes a first exterior side and a second interior side and an eccentric aperture extends from the first side to the second side of the holder.

In some embodiments of the helmet, a clip is engaged with the receiver, wherein the clip comprises a column with a central axis having a first axial side and a second axial side normal to the central axis, wherein the first side comprises a radially extending clamp arm, and the second side comprises a flange having a shape that fits within the eccentric aperture axially.

In some embodiments of the helmet, the eccentric aperture has a major axis and a minor axis, and the flange has a major axis that is slightly smaller than the major axis of the holder, and the flange has a minor axis that is slightly smaller than the minor axis of the holder.

In some embodiments of the helmet, the major axis of the flange is aligned with the major axis of the eccentric aperture, and the flange is free to move axially within the eccentric aperture.

In some embodiments of the helmet, rotation around the central axis of the column is resisted by resilient deformation of the column or the holder.

In some embodiments of the helmet, the major axis of the flange is aligned with the minor axis of the eccentric aperture, and the flange is locked from moving axially within the eccentric aperture.

In some embodiments of the helmet, rotation around the central axis of the column is resisted by resilient deformation of the column or the holder.

In some embodiments of the helmet, a cross-sectional shape of the column has an axis that is greater than the minor axis of the eccentric aperture and smaller than the major axis of the eccentric aperture.

In some embodiments of the helmet, a cross-sectional shape of the column engaged with the eccentric aperture is described by the intersection of two equal orthogonal axes, each one being greater than the minor axis of the eccentric aperture and smaller than the major axis of the eccentric aperture.

In some embodiments of the helmet, the cross-sectional shape of the column includes four curved elliptical segments, wherein two opposite elliptical segments are in contact with the eccentric aperture at the minor axis.

In some embodiments, the helmet comprises a vent opening that traverses the hard shell and interior foam layer, wherein the clip is engaged within the recess in the vent opening without significantly obstructing venting air from passing through the vent opening into an interior of the helmet.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
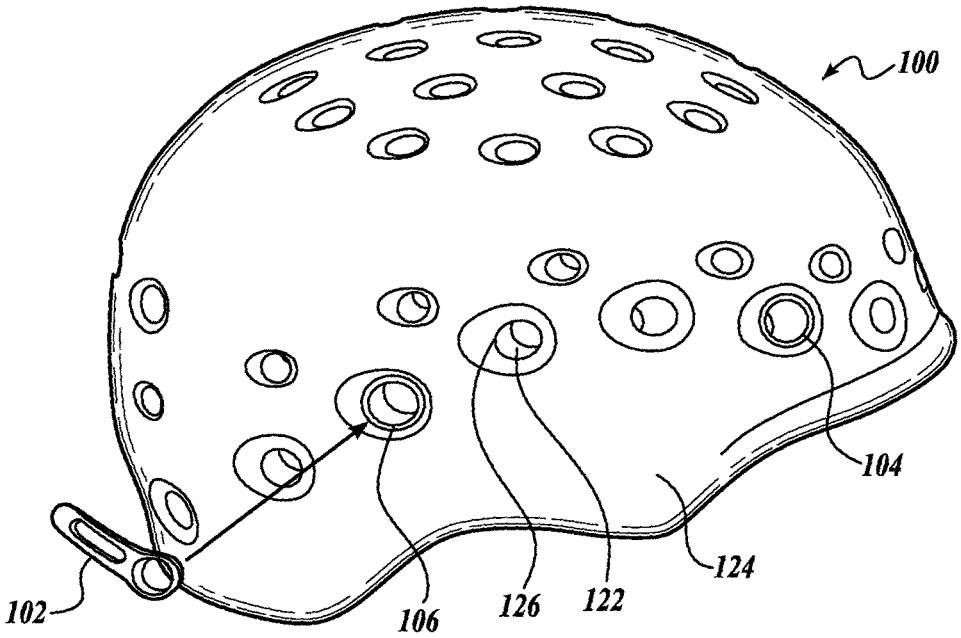
FIG. 1 is a diagrammatical illustration of a helmet having a receiver.
Figure 2:
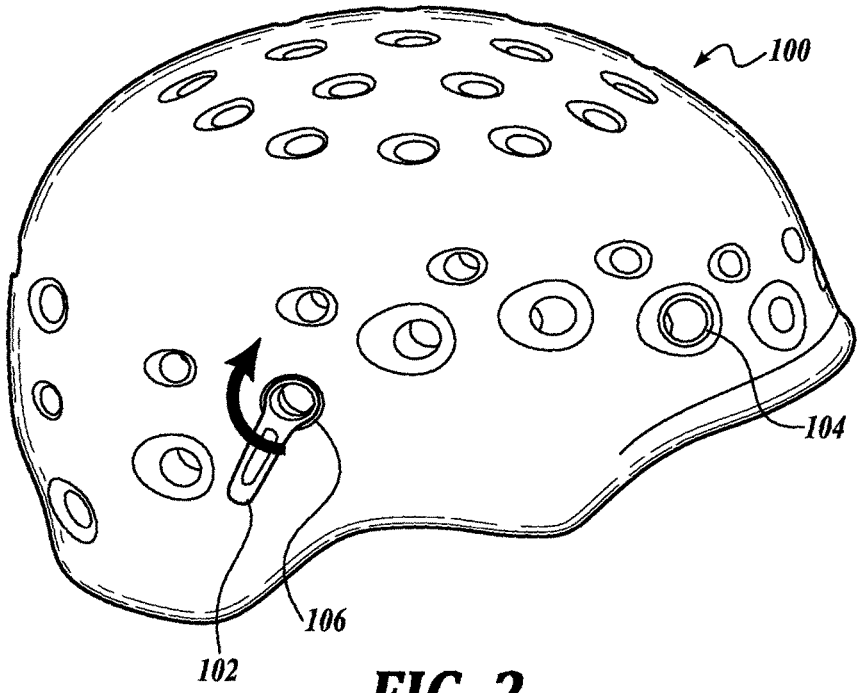
FIG. 2 is a diagrammatical illustration of a helmet having a clip in the receiver in the locked position.

The FIGURES illustrate a helmet 100 with a retaining system including a receiver and clip, as further described below. The clip serves to hold straps of goggles, headlamps, and other accessories. The helmet 100 may have an interior foam layer 122 as seen through a vent opening 126. The helmet 100 may have an exterior hard shell 124 bonded to or otherwise attached to the interior foam layer 122. The helmet 100 may have a plurality of clip anchor areas 104. A forward anchor area 104 and a rear anchor area 106 are placed on a side of the helmet 100. The anchor area is generally formed in a recess of the helmet, wherein the recess may penetrate through the hard shell and extend or traverse the foam layer. The helmet 100 may include one or a plurality of anchor areas on each side of the helmet 100 with corresponding anchor areas on the opposite side of the helmet 100.

Each anchor area includes a receiver 110. The receiver 110 has an anchor portion 118 and a holder portion 112. The anchor portion or anchor 118 is basically any type of structure that can be embedded to and made immovably fast onto the helmet. Generally, a helmet 100 includes a foam interior and a polycarbonate hard exterior. The anchor 118 may be a circular-like structure that may include ridges and/or grooves that mate with or that are otherwise held stationarily and immovably embedded or bonded to the foam layer and/or the polycarbonate hard shell. For example, the anchor 118 can include barbs that are embedded in the foam or the hard shell and resist being pulled out. Screws or rivets may also be used to hold the anchor 118 to the helmet. The anchor 118 may have a void in the center so as to allow the insertion of the removable clip 102. The holder portion or holder 112 is a structure that is attached to the anchor 118 so that the holder is generally exterior to the anchor 118. That is, when the receiver 110 is attached to the helmet, the holder 112 will be on the side facing the exterior. The holder 112 has a first side that is on the exterior and a second side that is interior thereto. The holder 112 can be made from a narrow wall (i.e., the height is greater than the thickness) such that the wall describes an eccentric aperture when seen from either the first side or the second side. The eccentric aperture extends from the first side to the second side of the holder 112. The eccentric aperture need not traverse the entire thickness of the helmet, and the eccentric aperture or holder may terminate before reaching the inner surface of the helmet. The eccentric aperture can be oval shaped. A rectangular shape can be used as well. Generally, any shape that is not perfectly circular can be used for the eccentric aperture and flange. The eccentric aperture can be an ellipse. As is well known, an ellipse has a major axis and a minor axis, wherein the major and minor axes are orthogonal to each other. The major axis is longer than the minor axis. The major axis divides the ellipse into two equal halves on both sides of the major axis, and the minor axis divides the ellipse into two equal halves on both sides of the minor axis.

The clip 102 of the FIGURES is designed to mate with the receiver 110. The clip 102 includes a column 116. The axial center 132 of the column 116 is a line about which the clip 102 rotates within the receiver 110. The column 116 may be described as having an axial end on both sides of the column. The column 116 is attached to a clamp arm 120 on one axial end, which will be seen as the exterior end. The clamp arm 120 extends radially outward from the column 116. When the clip 102 is engaged with the receiver 110, the clamp arm 120 will be on the exterior of the helmet so that the distal end of the clamp arm 120 may press against the exterior side of the shell. The clamp arm 120 is an elongated flat structure. The clamp arm 120 may curve so as to project toward the exterior shell of the helmet 100. The clamp arm 120 may terminate in an upturned portion to facilitate the placement of the strap from goggles by sliding between the clamp arm 120 and the shell. The column 116 is attached to a flange 114 on the axial end opposite from the clamp arm 120. The flange 114 outer perimeter extends outward beyond the outer perimeter of the column 116 so as to form a lip on the end of the column 116.

The flange 114 can be flat member that is attached to the column 116 so that the flat side of the flange 114 is normal to the central axis 132 of the column 116. The flange 114 can have a perimeter that is shaped similar to the eccentric aperture to allow passage of the flange 114 through the eccentric aperture in one orientation. However, the size of the flange 114 is slightly smaller than the size of the eccentric aperture to allow the flange 114 to be inserted or removed axially into and out of the eccentric aperture of the holder 112. For example, the flange 114 can also be an ellipse having a major axis 138 and a minor axis 140 that are only slightly smaller than the corresponding major axis 134 and minor axis 136 of the eccentric aperture of the holder 112. When the flange 114 is past the interior side of the holder 112, the clip 102 may be rotated around the central axis 132, say, about 90 degrees, thus aligning the major axis 138 of the flange 114 with the minor axis 136 of the eccentric aperture and rendering the flange 114 unable to move axially outward of the eccentric aperture of the holder 112 due to the overlapping part of the flange 114 that abuts against the second side of the holder 112. The clip 102 will provide sufficient holding strength in the direction that is parallel to the axial center 132 of the column in order to hold straps, such as for goggles and headlamps. The clip 102, however, will be able to rotate, albeit with some resistance.

In some embodiments, the anchor areas 104, where the clips 102 secure to, could be located within vent openings in the helmet 100. A vent opening traverses the hard shell and interior foam layer to permit venting air to pass from the outside into the interior of the helmet. When the receiver 110 is located within a recess in a vent opening, the receiver 110 and clip 102 are constructed to have openings that allow the venting air to pass into the helmet interior without significantly obstructing the ventilation properties. For example, the column 116 of the clip 102 can be a cylinder, wherein the center is hollowed out to allow venting air to pass through the column 116 to the interior of the helmet 100.

Figure 3:
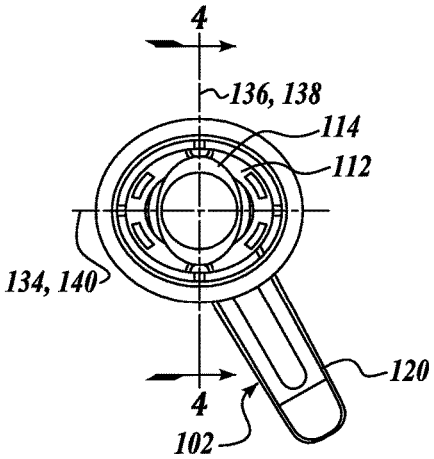
FIG. 3 is a diagrammatical illustration of a clip in a receiver in the locked position.
Figure 4:
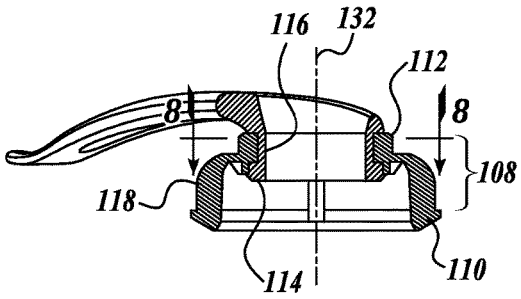
FIG. 4 is a diagrammatical illustration of a clip in a receiver in the locked position.
Figure 5:
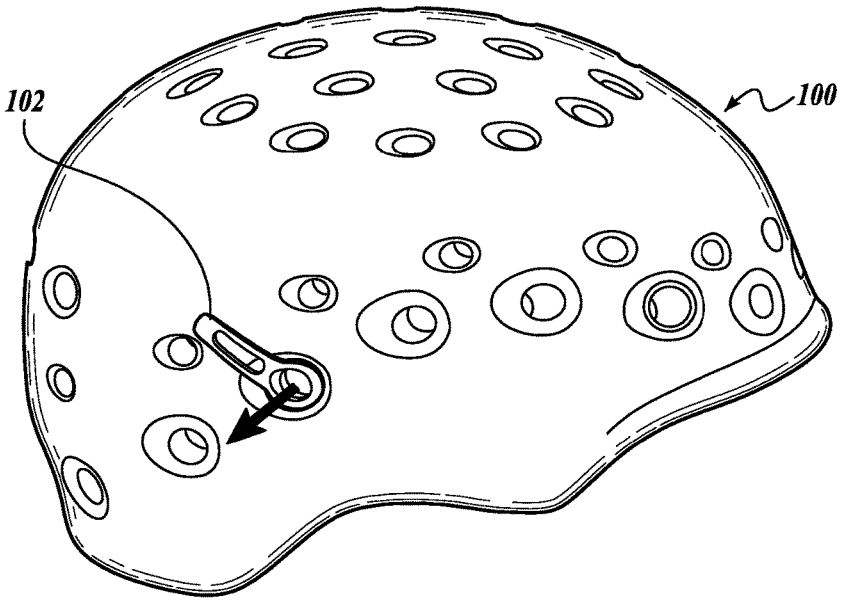
FIG. 5 is a diagrammatical illustration of a helmet having a clip in the receiver in the unlocked position.

As shown in FIG. 3, the shape of the flange 114 when viewed normal to the central axis 132 of the column 116 has an eccentric shape, wherein the size of the eccentric shape of the flange 114 is only slightly smaller than the size of the eccentric aperture of the holder 112. In FIG. 3, the major axis 138 of the flange 114 is orthogonal to the major axis 134 of the eccentric aperture of the holder 112, and therefore the clip 102 is in the locked position in the receiver 110. FIG. 4 shows a cross-sectional view of the locked position shown in FIG. 3. The flange 114 abuts against the second interior side of the holder 112, and the column 116 passes through the eccentric aperture in the holder 112 from the first exterior side to the second interior side. The retaining system, that is, the holder 112, the column 116, and the flange 114, may be used in other applications besides clips. For example, the straps can be directly connected to the column 116. It should be appreciated that other shapes of the flange and eccentric aperture that are not perfectly circular will have some overlapping area when rotated: for example, rectangles, ovals, and even squares.

Figure 6:
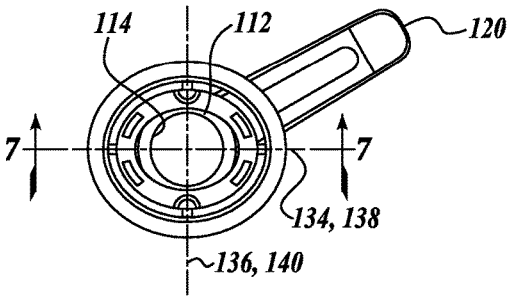
FIG. 6 is a diagrammatical illustration of a clip in a receiver in the unlocked position.
Figure 7:
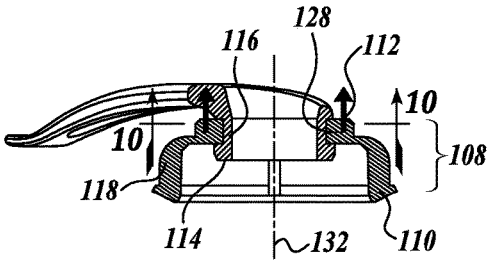
FIG. 7 is a diagrammatical illustration of a clip in a receiver in the unlocked position.

Referring to FIG. 6, the clip 102 has been rotated 90 degrees around the central axis 132 of the column 116 as compared to FIG. 3. In the position shown in FIG. 6, the flange 114 is aligned with the eccentric aperture in the holder 112. Therefore, the major axis 138 of the flange 114 is aligned with the major axis 134 of the eccentric aperture in the holder 112, and the flange 114 can fit within and pass axially through the eccentric aperture from the second side to the first side to release it from the receiver 110. It should be appreciated that when the flange 114 is aligned with the eccentric aperture in the holder 112, the flange 114 can initially be inserted into the holder 112 from the first side to the second side. The outer dimension of the column 116 is at least no larger than the outer dimension of the flange 114 to allow the column to fit within the eccentric aperture from the first side to the second side. When the flange upper surface passes the holder 112 lower surface on the second side, the clip 102 may be rotated 90 degrees so that the major axis 138 of the flange is orthogonal to the major axis 134 of the eccentric aperture. In other words, the major axis 138 of the flange 114 may be aligned with the minor axis 136 of the eccentric aperture. The holder 112, flange 114, and column 116 form the retaining system 108. In addition to providing a disengaging/engaging system, the clip 102 is designed to resist rotational movement.

As can be appreciated, when the major axis 138 of the flange 114 is orthogonal to the major axis 134 of the eccentric aperture, the flange will resist disengagement by any axial force outward. It should be understood that one purpose of the clips 102 is to basically hold the straps to the side of the helmet and prevent their slipping up or down from the helmet. The forward thrust induced by the strap is generally borne by the rear of the helmet. Once the clip 102 has been locked into the anchor area 104, there are various embodiments that can provide resistance to rotation along the central axis 132 to keep the clip 102 in the locked position.

Figure 8:
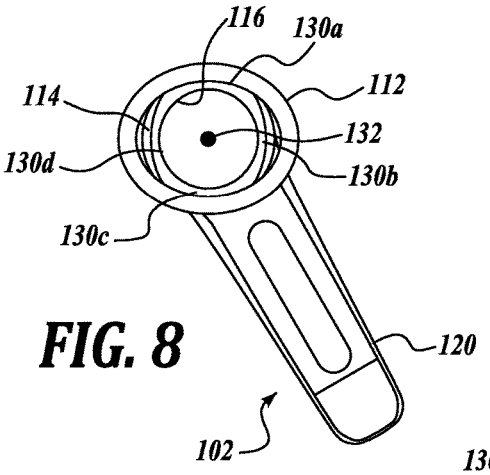
FIG. 8 is a diagrammatical illustration of a clip in a holder in the locked position.
Figure 9:
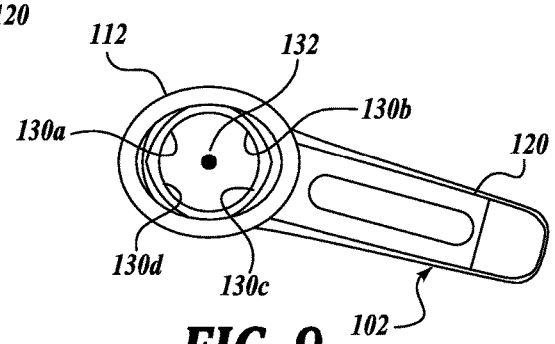
FIG. 9 is a diagrammatical illustration of a clip in a holder in halfway position between locked and unlocked.
Figure 10:
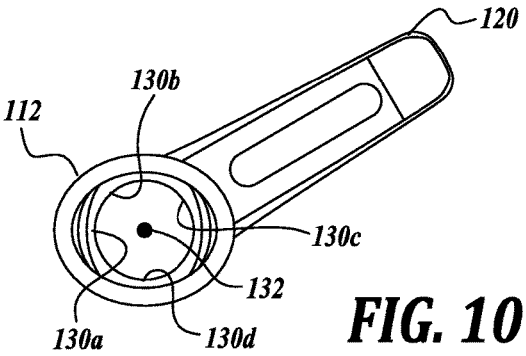
FIG. 10 is a diagrammatical illustration of a clip in a holder in the unlocked position.

FIG. 8 shows the cross-sectional shape of the column 116 normal to the central axis 132 when the clip 102 is in the locked position of FIGS. 3 and 4. The column 116 is engaged within the eccentric aperture of the holder 112. The column 116 has an exterior shape such that the shape wants to rest naturally against the sides of the eccentric aperture of the holder 112 in both the locked and the unlocked position. In FIG. 8, the cross-sectional shape of the column 116 is described by a "square," because the shape has four similar sides 130*a*, 130*b*, 130*c*, and 130*d*. Each side 130*a*, 130*b*, 130*c*, and 130*d* is shaped similar to a segment of the elliptical eccentric aperture instead of being a straight side. The cross-sectional shape of the column can be seen to have four defined points or corners where two sides meet. Each pair of opposite diagonal corners describes an axis that is greater than the minor axis 136, but less than the major axis 134 of the eccentric aperture. As can be appreciated, the elliptical segments of the column 116 can nest against the elliptical shape of the eccentric aperture because they are a similar shape. A four-sided structure allows nesting of the column 116 against the eccentric aperture at four different positions. Two of those positions are locked positions, and the other two positions are unlocked positions that allow the column 116 to slide axially while inserting or removing the clip 102 from the receiver 110. The receiver 110 can be rotationally aligned in the helmet 100 to provide the correct angle of the straps such that the clip is aligned in the desired direction when in the locked position. The number of sides of the cross-sectional shape of the column 116 may be varied. The shape described by the column 116 includes the two orthogonal equal axes ending at the four corners, each of which is the same distance from the central axis 132. The shape between any two adjacent corners assumes the shape of the eccentric aperture. Accordingly, such shape will want to nest naturally in both the locked and unlocked position. As can be seen, the sides 130*a* and 130*c* nest juxtaposed next to the eccentric aperture. In order to move from the locked position to the unlocked position or vice versa, either the column 116 and/or the holder 112 will need to resiliently deform momentarily. Any material that can deform momentarily and then resume the original shape can be used. Plastics and metals, provided the metal is deformable, may be suitable. Because the diagonal corner-to-corner length is greater than the minor axis 136 of the eccentric aperture and less than the major axis 134 of the eccentric aperture, resistance is encountered upon rotation. FIG. 9 shows rotation of the clip 102 around the central axis 132 by 45 degrees as compared to FIG. 8. In FIG. 9, the corner-to-corner diagonal is aligned with the minor axis 136 of the eccentric aperture, which causes either the corners and/or the eccentric aperture in the holder 112 to deform. Thus, to move between the locked position to the unlocked position, some deformation in either the column 116, the holder 112, or the flange 114 takes place. This deformation provides the resistance between the locked and the unlocked positions. FIG. 10 shows rotation around the central axis 132 by 90 degrees as compared to FIG. 8, and the clip 102 has moved to the unlocked position. As can be seen, sides 130*b* and 130*d* nest juxtaposed next to the inside of the eccentric aperture. Therefore, resistance is encountered upon both unlocking and locking the clip 102 in the receiver 110.

In other embodiments, other features may be used to provide the resistance to rotation. For example, in one embodiment, the side of the flange that touches the second side of the holder 112 can include one or more ramps. The ramp may have a short ramp and a long ramp, thus making rotation in one direction easier. The ramp may be placed on both the upper side of the flange and the second side of the holder. Additionally, or alternatively, a semicircular bump or projection can be placed on either the column 116 or the holder 112. The bump or bumps can nest in a groove in the locked and unlocked position, and resistance is felt when moving the bump out of the groove. In other alternatives, a spring, snap ring, or spring washer may be used to provide some resistance to rotation. For example, the snap ring or spring washer may provide resistance by pressing the flange against the holder via a spring action, thus inducing resistance to rotation.

Figure 11:
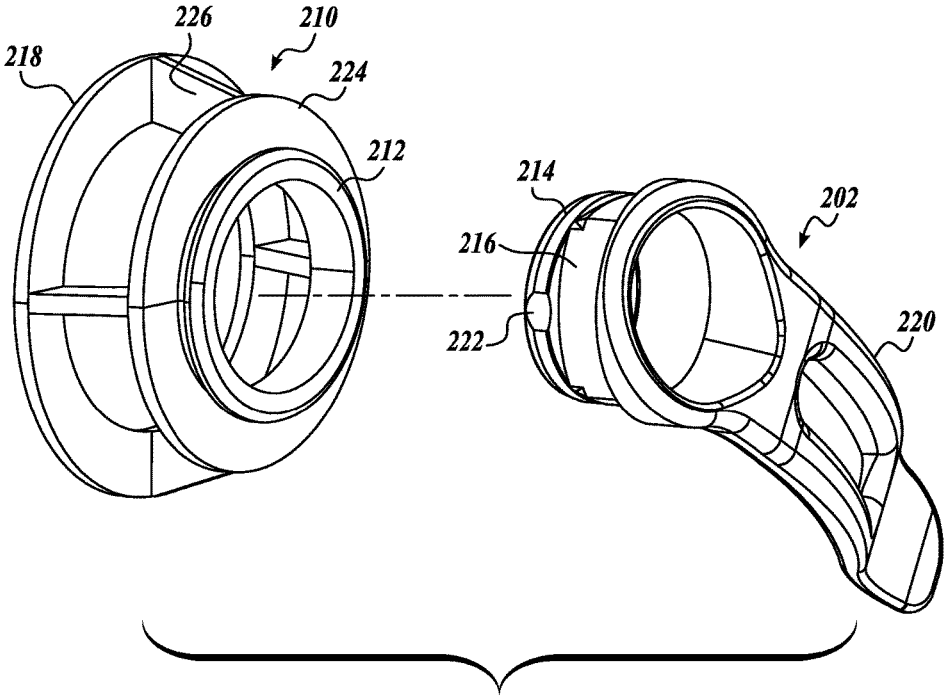
FIG. 11 is a diagrammatical illustration of a clip and receiver forming a second embodiment of a retaining system.

FIG. 11 is a diagrammatical illustration of a second embodiment of a retaining system. The system of FIG. 11 may be incorporated into headgear, such as helmet 100. The system includes a clip 202 that is inserted into a receiver 210. The receiver 210 includes an anchor 218 and a holder 212. The holder 212 is supported to the anchor 218 via struts 226 spaced equidistantly around the anchor 218 and a disk 224. The disk 224 in turn supports the holder 212. The anchor 218 may be embedded within a foam layer of a helmet, for example. The holder 212 includes an eccentric aperture in the center thereof. In this case, the eccentric aperture of the holder is elliptically shaped. As with the other embodiments, the eccentric aperture can include a plurality of non-circular apertures.

The clip 202 optionally includes an arm 220 for retaining goggles straps, for example. However, other embodiments may have other accessories in place of the arm. The clip 202 includes a column 216, which in turn is connected to a flange 214. The column 216 may be hollow. The hollow center may allow the column 216 to deform resiliently upon rotation of the clip 1202 in the holder 212. The flange 214 can project radially outward from the perimeter of the column 216 to form a lip. The flange 214 is also elliptically shaped to fit within the eccentric aperture of the holder 212, such that there are two orientations that allow insertion. The flange 214 may include one or more notches 222 on the other edge thereof. The notch 222 may rest against the strut inside edge so that the clip 202 resists rotation. The column 216 can include four exterior longitudinal sides, each side having a shape that corresponds to a segment of the elliptical shape. As with the previous embodiment, once inserted into the receiver 210, the clip 202 can resiliently resist rotation, and rotation is accomplished by resilient deformation of either the holder 212, the flange 214, or the column 216, or a combination of two or a combination of all three features. The clip 220 resists being axially pulled out of the receiver 210 via the lip formed by the flange 214. When the clip 202 is inserted into the receiver 210 and rotated, the lip formed by the flange 214 will reside underneath the edge of the holder 212, thus, preventing axial motion. In FIG. 3, the flange 114 is seen in a position that prevents axial motion when the flange 114 is resided against the bottom side of the holder 112.

Embodiments relate to a retaining system. The retaining system includes a receiver comprising a holder with a first side and an opposite second side and an eccentric aperture that extends from the first side to the second side of the holder; a column comprising a central axis, a first axial side, and a second opposite axial side; and a flange attached normal to the column at the second side, wherein the column and flange are engaged with the holder, wherein the flange has an outer shape that fits within the eccentric aperture, and the column passes within the eccentric aperture from the first side to the second side of the holder, wherein the flange and column are rotatable around the central axis, and the column resists rotating without some resilient deformation of either the column, the flange, or the holder.

In some embodiments of the retaining system, the eccentric aperture has an elliptical shape having a major axis and a minor axis, and the flange has a major axis and a minor axis slightly smaller than the major axis and minor axis of the eccentric aperture.

In some embodiments of the retaining system, the major axis of the flange is aligned with the major axis of the eccentric aperture, and the flange is free to move in a direction parallel to the central axis within the eccentric aperture.

In some embodiments of the retaining system, the major axis of the flange is not aligned with the major axis of the eccentric aperture, and the flange rests against the second side of the holder and is prevented from movement in a direction parallel to the central axis.

In some embodiments of the retaining system, a cross-sectional shape of the column has an axis that is greater than the minor axis of the elliptical eccentric aperture and smaller than the major axis of the elliptical eccentric aperture.

In some embodiments of the retaining system, the holder has a wall forming the eccentric aperture, wherein a height of the wall is greater than a thickness of the wall.

In some embodiments of the retaining system, a cross-sectional shape of the column engaged with the eccentric aperture is described by the intersection of two equal orthogonal axes, each one being greater than the minor axis of the elliptical shape and smaller than the major axis of the elliptical shape.

In some embodiments of the retaining system, the cross-sectional shape of the column includes four curved elliptical segments, wherein two opposite segments are in contact with the eccentric aperture at the minor axis.

In some embodiments of the retaining system, the receiver further comprises an anchor structure attached to the holder.

In some embodiments of the retaining system, a clamp arm is connected to the first side of the column, wherein the clamp arm extends radially from the column.

In some embodiments of the retaining system, the eccentric aperture has a shape other than circular.

Some embodiments relate to a helmet having any of the embodiments of the retaining system.

Some embodiments relate to a helmet including an interior foam layer, an exterior hard shell attached to the interior foam layer, wherein a recess is provided in the exterior hard shell and interior foam layer, and a receiver placed in the recess, wherein the receiver comprises an anchor immovably attached to the recess and a holder connected to the anchor, wherein the holder includes a first exterior side and a second interior side and an eccentric aperture extends from the first side to the second side of the holder.

In some embodiments of the helmet, a clip is engaged with the receiver, wherein the clip comprises a column with a central axis having a first axial side and a second axial side normal to the central axis, wherein the first side comprises a radially extending clamp arm, and the second side comprises a flange having a shape that fits within the eccentric aperture axially.

In some embodiments of the helmet, the eccentric aperture has a major axis and a minor axis, and the flange has a major axis that is slightly smaller than the major axis of the holder, and the flange has a minor axis that is slightly smaller than the minor axis of the holder.

In some embodiments of the helmet, the major axis of the flange is aligned with the major axis of the eccentric aperture, and the flange is free to move axially within the eccentric aperture.

In some embodiments of the helmet, rotation around the central axis of the column is resisted by resilient deformation of the column or the holder.

In some embodiments of the helmet, the major axis of the flange is aligned with the minor axis of the eccentric aperture, and the flange is locked from moving axially within the eccentric aperture.

In some embodiments of the helmet, rotation around the central axis of the column is resisted by resilient deformation of the column or the holder.

In some embodiments of the helmet, a cross-sectional shape of the column has an axis that is greater than the minor axis of the eccentric aperture and smaller than the major axis of the eccentric aperture.

In some embodiments of the helmet, a cross-sectional shape of the column engaged with the eccentric aperture is described by the intersection of two equal orthogonal axes, each one being greater than the minor axis of the eccentric aperture and smaller than the major axis of the eccentric aperture.

In some embodiments of the helmet, the cross-sectional shape of the column includes four curved elliptical segments, wherein two opposite elliptical segments are in contact with the eccentric aperture at the minor axis.

While illustrative embodiments have been illustrated and described, it will be appreciated that various changes can be made therein without departing from the spirit and scope of the invention.

The embodiments of the invention in which an exclusive property or privilege is claimed are defined as follows:

1. A retaining system, comprising:

a receiver comprising a holder with a first side and an opposite second side and an eccentric aperture extends from the first side to the second side of the holder;

a column comprising a central axis, a first axial side, and a second opposite axial side; and a flange attached normal to the column at the second side, wherein the column and flange are engaged with the holder, wherein the flange has an outer shape that fits within the eccentric aperture, and the column passes within the eccentric aperture from the first side to the second side of the holder, wherein the flange and column are rotatable around the central axis with respect to the receiver, and the column resists rotating without some resilient deformation of either the column, the flange, or the holder.

2. The retaining system of claim 1, wherein the eccentric aperture has an elliptical shape having a major axis and a minor axis, and the flange has a major axis and a minor axis slightly smaller than the major axis and minor axis of the eccentric aperture.

3. The retaining system of claim 2, wherein the major axis of the flange is aligned with the major axis of the eccentric aperture, and the flange is free to move in a direction parallel to the central axis within the eccentric aperture.

4. The retaining system of claim 2, wherein the major axis of the flange is not aligned with the major axis of the eccentric aperture, and the flange rests against the second side of the holder and is prevented from movement in a direction parallel to the central axis.

5. The retaining system of claim 2, wherein a cross-sectional shape of the column has an axis that is greater than the minor axis of the elliptical eccentric aperture and smaller than the major axis of the elliptical eccentric aperture.

6. The retaining system of claim 1, wherein the holder has a wall forming the eccentric aperture, wherein a height of the wall is greater than a thickness of the wall.

7. The retaining system of claim 2, wherein a cross-sectional shape of the column engaged with the eccentric aperture is described by the intersection of two equal orthogonal axes, each one being greater than the minor axis of the elliptical shape and smaller than the major axis of the elliptical shape.

8. The retaining system of claim 2, wherein the cross-sectional shape of the column includes four curved elliptical segments, wherein two opposite segments are in contact with the eccentric aperture at the minor axis.

9. The retaining system of claim 1, wherein the receiver further comprises an anchor structure attached to the holder.

10. The retaining system of claim 1, further comprising a clamp arm connected to the first side of the column, wherein the clamp arm extends radially from the column.

11. The retaining system of claim 1, wherein the eccentric aperture has a shape other than circular.

12. A helmet, comprising the retaining system of claim 1.

13. A helmet, comprising:

an interior foam layer;

an exterior hard shell attached to the interior foam layer, wherein a recess is provided in the exterior hard shell and interior foam layer, wherein the recess penetrates through the hard shell and extends to or traverses the interior foam layer; and a receiver placed in the recess, wherein the receiver comprises an anchor immovably attached to the recess and a holder connected to the anchor, wherein the holder is exterior relative to the anchor, wherein the holder includes a first exterior side and a second interior side, and an eccentric aperture extends from the first exterior side to the second interior side of the holder.

14. The helmet of claim 13, further comprising a clip engaged with the receiver, wherein the clip comprises a column with a central axis having a first axial side and a second axial side normal to the central axis, wherein the first side comprises a radially extending clamp arm, and the second side comprises a flange having a shape that fits within the eccentric aperture axially.

15. The helmet of claim 14, wherein the eccentric aperture has a major axis and a minor axis, and the flange has a major axis that is slightly smaller than the major axis of the holder, and the flange has a minor axis that is slightly smaller than the minor axis of the holder.

16. The helmet of claim 15, wherein the major axis of the flange is aligned with the major axis of the eccentric aperture, and the flange is free to move axially within the eccentric aperture.

17. The helmet of claim 16, wherein rotation around the central axis of the column is resisted by resilient deformation of the column or the holder.

18. The helmet of claim 15, wherein the major axis of the flange is aligned with the minor axis of the eccentric aperture, and the flange is locked from moving axially within the eccentric aperture.

19. The helmet of claim 18, wherein rotation around the central axis of the column is resisted by resilient deformation of the column or the holder.

20. The helmet of claim 15, wherein a cross-sectional shape of the column has an axis that is greater than the minor axis of the eccentric aperture and smaller than the major axis of the eccentric aperture.

21. The helmet of claim 15, wherein a cross-sectional shape of the column engaged with the eccentric aperture is described by the intersection of two equal orthogonal axes, each one being greater than the minor axis of the eccentric aperture and smaller than the major axis of the eccentric aperture.

22. The helmet of claim 15, wherein the cross-sectional shape of the column includes four curved elliptical segments, wherein two opposite elliptical segments are in contact with the eccentric aperture at the minor axis.

23. The helmet of claim 14, wherein the helmet comprises a vent opening that traverses the hard shell and interior foam layer, wherein the clip is engaged within the recess in the vent opening without significantly obstructing venting air from passing through the vent opening into an interior of the helmet.

* * * * *